US007461452B1

(12) United States Patent
Kothari

(10) Patent No.: US 7,461,452 B1
(45) Date of Patent: Dec. 9, 2008

(54) TECHNIQUE FOR SETTING PRECIOUS STONES SUCH AS DIAMONDS

(75) Inventor: Premkumar L. Kothari, Mumbai (IN)

(73) Assignee: Fine Jewellery (India) Ltd., Mumbai (IN)

( * ) Notice: Subject to any disclaimer, the term of this patent is extended or adjusted under 35 U.S.C. 154(b) by 602 days.

(21) Appl. No.: 11/184,132

(22) Filed: Jul. 18, 2005

(51) Int. Cl.
*A44C 1/00* (2006.01)
*A44C 17/00* (2006.01)
*A44C 27/00* (2006.01)
*B23P 5/00* (2006.01)

(52) U.S. Cl. ..... 29/896.412; 29/896.4; 29/896.41; 29/896.411; 29/10; 63/28; 63/27; 63/20; D11/92; D11/37; D11/36; D11/34

(58) Field of Classification Search ..... 29/896.4, 29/896.41, 896.411, 896.412, 10; 63/20, 63/27, 28; D11/94, 36–37, 34
See application file for complete search history.

(56) References Cited

U.S. PATENT DOCUMENTS

| | | | | |
|---|---|---|---|---|
| 18,288 | A * | 9/1857 | Lindsley | 63/28 |
| 677,075 | A | 6/1901 | Fuchs | |
| 736,022 | A | 8/1903 | Rohde | |
| 1,818,324 | A | 8/1931 | Hamin | |
| 2,058,978 | A | 10/1936 | Hamin | |
| 2,774,231 | A | 12/1956 | Peterson | |
| 5,099,660 | A | 3/1992 | Dostourian | |
| D409,518 | S | 5/1999 | Ho | |
| D480,659 | S | 10/2003 | Paschauer | |
| D485,509 | S | 1/2004 | Shagalov | |
| D498,699 | S | 11/2004 | Shagalov | |

* cited by examiner

*Primary Examiner*—David P. Bryant
*Assistant Examiner*—Alexander P Taousakis
(74) *Attorney, Agent, or Firm*—Thomas I. Rozsa

(57) ABSTRACT

The present invention is a novel technique for setting a multiplicity of precious stones such as diamonds into a unique setting to enhance the beauty and presentation of the multiplicity of set stones, with the technique including setting a center stone held by small prongs, an outer series of stones wherein each outer stone is held by a pair of large prongs, and an intermediate series of stones held by the larger outer prongs which hold the small stones so that the intermediate stones partially cover the center stone and outer series of stones in a manner which conceals the way the outer stones are held.

10 Claims, 2 Drawing Sheets

TECHNIQUE FOR SETTING PRECIOUS STONES SUCH AS DIAMONDS

BACKGROUND OF THE INVENTION

1. Field of the Invention

The present invention relates to the field of jewelry and more particularly to precious stones such as diamonds. The present invention focuses on the area ofjewelry which is involved with setting precious stones such as diamonds into a mounting.

2. Description of the Prior Art

In general, the techniques for setting diamonds and other precious stones have been known for many centuries. The following ten (10) patents are relevant to the present invention:

1. U.S. Pat. No. 677,075 issued to R. Fuchs on Jun. 25, 1901 for "Cluster Setting" (hereinafter the "Fuchs patent");
2. U.S. Pat. No. 736,022 issued to F. W. Rhode on Aug. 11, 1903 for "Cluster Setting for Rings, Brooches, or the Like" (hereinafter the "Rhode patent");
3. U.S. Pat. No. 1,818,324 issued to S. A. Hamin on Aug. 11, 1931 for "Means and Method for Mounting Stones and the Like" (hereinafter the "'324 Hamin patent");
4. U.S. Pat. No. 2,058,978 issued to S. A. Hamin on Sep. 14, 1935 for "Jewel Mounting" (hereinafter the "'978 Hamin patent");
5. U.S. Pat. No. 2,774,231 issued to H. Peterson on Dec. 28, 1953 for "Mounting Having a Large Central Gem Overlying Adjacent Small Gems" (hereinafter the "Peterson patent");
6. U.S. Pat. No. 5,009,660 issued to Dostourian on Mar. 31, 1992 for 9 "Mounting for Gem Stones" (hereinafter the "Dostourian patent");
7. U.S. Pat. No. Des. 409,518 issued to Nelson Chi Kai Ho on May 11, 1999 for "Diamond Article of Jewelry" (hereinafter the "Ho patent");
8. U.S. Pat. No. D480,659 S issued to Werner Pachauer on Oct. 14, 2003 for "The Ornamental Design for Overlap Setting" (hereinafter the "Pachauer patent");
9. U.S. Pat. No. D485,509 S issued to Simon Shagalov on Jan. 20, 2004 for "Jewelry Precious Stone Arrangement" (hereinafter the "'509 Shagalov patent");
10. U.S. Pat. No. D498,699 S issued to Simon Shagalov on Nov. 23, 2004 for "Precious Stone Arrangement" (hereinafter the "'699 Shagalov patent").

The Fuchs patent which issued in 1901 has as its concept the use of a sheet metal ring with annular series of extending prongs which support the stones. The sheet metal ring is shown in FIG. 4.

The Rohde patent which issued in 1903 discloses a cluster setting.

The '324 Hamin patent has a base member 11 is secured to a shank of the ring and the base comprises a shell having an upstanding wall 12 which is struck or serrated so as to generally conform to the outer edges of the series of encircling stones. The central stone member illustrated in FIG. 3 is provided with an upstanding wall 21 having a plain or pointed top from which extends an inwardly directed shoulder 22 and a depending inwardly inclined wall or flange 23.

The '978 Hamin patent which issued in 1936 has a jewelry mounting as best illustrated in FIG. 3 where one stone is mounted above another.

The Peterson patent is a mounting having a large central gem overlying adjacent small gems. In this case as you can see, the smaller gems are supported by prongs and then the large overlying gems partially cover those smaller gems.

The Dostourian patent is a mounting for gem stones which basically shows a plurality of large round diamonds and small round diamonds with the pavilion portion of the large round diamonds bearing directly upon and overlying, at least a portion, of the crown of the smaller round diamonds such that individual metallic prongs for the diamonds are eliminated.

The Ho patent is a design patent which protects the shape of the object wherein there are a multiplicity of smaller stones with a large stone covering a portion of the smaller stones.

The Pachauer patent is also a design patent that protects the shape of the jewelry design. The design is that of an overlapping setting which shows a center stones surrounded by six stones, one above, one below and two on each side.

The '509 Shagolov patent is a jewelry arrangement of precious stones which is also a design patent. This design arrangement has the center stone above the other stones.

The '699 Shagalov patent is a design patent that protects the concept of overlaying stones wherein the center stone is supported by four stones on the outside and there are four lower stones which the center stone covers.

SUMMARY OF THE INVENTION

The present invention is a novel technique for setting a multiplicity of precious stones such as diamonds into a unique setting to enhance the beauty and presentation of the multiplicity of set stones, with the technique including setting a center stone held by small prongs, an outer series of stones wherein each outer stone is held by a pair of large prongs, and an intermediate series of stones held by the larger outer prongs which hold the small stones so that the intermediate stones partially cover the center stone and outer series of stones in a manner which conceals the way the outer stones are held.

It is an object of the present invention to create a technique for setting precious stones in a mounting so that a large center stone is held by a multiplicity of small prongs, an outer series of preferably small stones are respectively held by pairs of large prongs, and an intermediate series of stones are held by the same large prongs which hold the small stones by each intermediate stone is held by two prongs selected form one each of an from an adjacent pair of prongs so that each of the intermediate stones at least partially cover a portion of two adjacent outer stones so that the way the outer stones are held is concealed.

It is a further object of the present invention to vary the size of the stones so that the center stone can be the smallest stone or the intermediate stones and the outer stones can be the same size or larger than the center stone.

It is further object of the present invention to vary the size of the stones proportionately so to make the outer dimension smaller or larger. The stones 78 through 88 will be the smallest in the entire mounting. The stones 90 through 100 will be the medium size stones in the entire mounting. And the center stone 76 will be the largest stone in the entire mounting. Further this proportion will always remain the same and will vary accordingly to achieve larger or smaller outer dimension.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
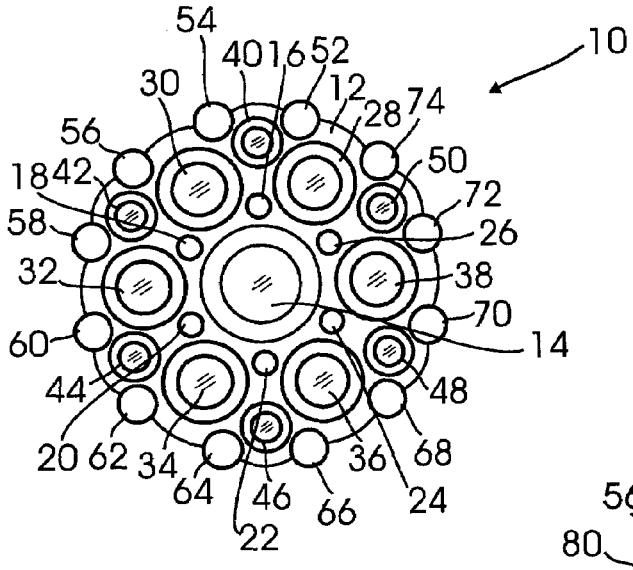
FIG. 1 is a top plan view of the jewelry mounting without any precious stones retained thereon.
Figure 2:
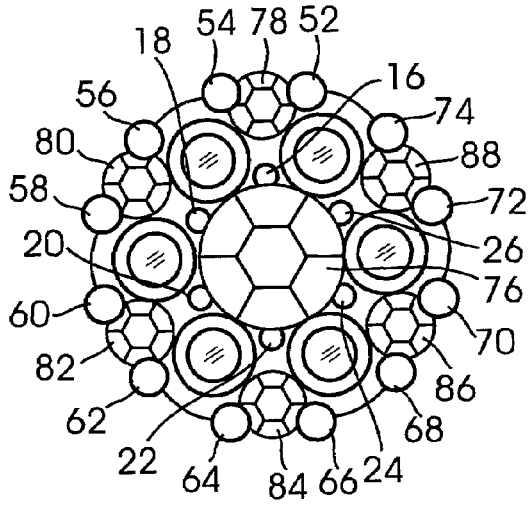
FIG. 2 is a top plan view of the jewelry mounting with a center large diamond set in place and six smaller diamonds also set in place and in the same row as the center large diamond.

The present invention technique for setting diamonds and other precious stones begins with a mounting base 10. As illustrated in FIG. 1, the mounting base 10 has a floor 12 onto which is formed a large centrally disposed receiving member or cavity 14. The center cavity 14 is surrounded by six small embedded prongs 16, 18, 20, 22, 24 and 26 which are spaced around center cavity 14. Looking down on the setting base 10, one small prong 16 is above the center cavity 14, one small prong 22 is oppositely disposed to small prong 16 and is below the center cavity 14, two small prongs 18 and 20 are to one side of the center cavity 14 and the two remaining small prongs 24 and 26 are set to the opposite side of the center cavity 14 and are respectively aligned with small prongs 18 and 20. Spaced between each pair of small prongs and positioned radially outward from the small prongs are six medium sized cavities 28, 30, 32, 34, 36 and 38. Medium sized cavity 28 is positioned between and radially outward from small prongs 26 and 16. Medium sized cavity 30 is positioned between and radially outward from small prongs 16 and 18. Medium sized cavity 32 is positioned between and radially outward from small prongs 18 and 20. Medium sized cavity 34 is positioned between and radially outward from small prongs 20 and 22. Medium sized cavity 36 is positioned between and radially outward from small prongs 22 and 24. Medium sized cavity 38 is positioned between and radially outward from small prongs 24 and 26. Spaced between each pair of medium sized cavities and positioned radially outward from the six medium sized cavities are six small cavities 40, 42, 44, 46, 48 and 50. Small cavity 40 is positioned between and radially outward from medium sized cavities 28 and 30. Small cavity 42 is positioned between and radially outward from medium sized cavities 30 and 32. Small cavity 44 is positioned between and radially outward from medium sized cavities 32 and 34. Small cavity 46 is positioned between and radially outward from medium sized cavities 34 and 36. Small cavity 48 is positioned between and radially outward from medium sized cavities 36 and 38. Positioned radially outward from and on opposite upper sides of the small cavities are six pairs of larger outer prongs. The larger outer prongs are 52, 54, 56, 58, 60, 62, 64, 66, 68, 70, 72 and 74. Larger outer prongs 52 and 54 are radially outward from and spaced adjacent opposite upper edges of small cavity 40. Larger outer prongs 56 and 58 are radially outward from and spaced adjacent opposite upper edges of small cavity 42. Larger outer prongs 60 and 62 are radially outward from and spaced adjacent opposite upper edges of small cavity 44. Larger outer prongs 64 and 66 are radially outward from and spaced adjacent opposite upper edges of small cavity 46. Larger outer prongs 68 and 70 are radially outward from and spaced adjacent opposite upper edges of small cavity 48. Larger outer prongs 72 and 74 are radially outward from and spaced adjacent opposite upper edges of small cavity 50

By way of example only, the diameter for the large center cavity can be 1.60 mm for 0.25 carat models and 1.70 mm for 0.50 carat models. The diameter for the medium sized cavities can be 1.10 mm for 0.25 carat models and 1.20 mm for 0.50 carat models. The diameter for small sized cavities can be 0.30 mm for 0.25 carat models and 0.60 mm for 0.50 carat models. For 0.25 carat models, the small inner prongs can be 0.50 mm in diameter and the larger outer prongs can be 0.75 mm in diameter. For 0.50 carat models, the small inner prongs can be 0.45 mm and the larger outer prongs can be 0.80 mm.

The setting technique will now be described. The large center stone 76 is set first and is set so that its pavilion is placed within the center cavity 14 and the stone 76 held adjacent its girdle by the six small prongs 16, 18, 20, 22, 24, and 26 so that its facets are exposed. Then each outer small stone 78, 80, 82, 84, 86 and 88 is set along the outer periphery so that their pavilions are respectively placed within a small cavity and are respectively held adjacent its girdle by a set of two larger prongs. For outer small stone 78, its pavilion is placed within cavity 40 and it is held adjacent its girdle by large prongs 52 and 54. For outer small stone 80, its pavilion is placed within cavity 42 and it is held adjacent its girdle by large prongs 56 and 58. For outer small stone 82, its pavilion is placed within cavity 44 and it is held adjacent its girdle by large prongs 60 and 62. For outer small stone 84, its pavilion is placed within cavity 46 and it is held adjacent its girdle by large prongs 64 ands 66. For outer small stone 86, its pavilion is placed within cavity 48 and it is held adjacent its girdle by large prongs 68 and 70. For outer small stone 88, its pavilion is placed within cavity 50 and it is held adjacent its girdle by large prongs 72 and 74. The upper portion of the crown of each of the small stones 78, 80, 82, 84, 86 and 88 are on the same horizontal level as upper portion of the crown of the large stone 76.

Figure 3:
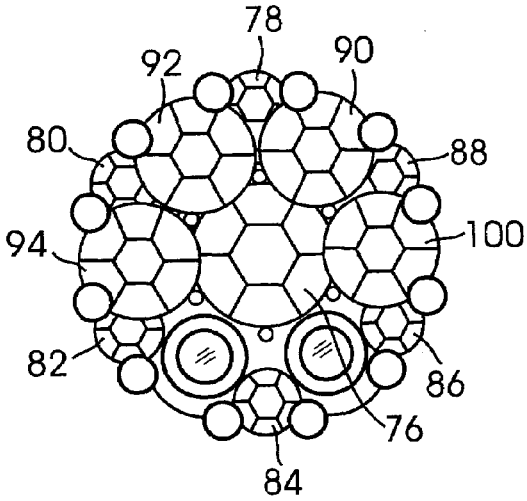
FIG. 3 is a top plan view of the jewelry mounting with a center large diamond set in place, six outer smaller diamonds also set in place and in the same row as the center large diamond, and four of the intermediate upper group of diamonds set in place.
Figure 4:
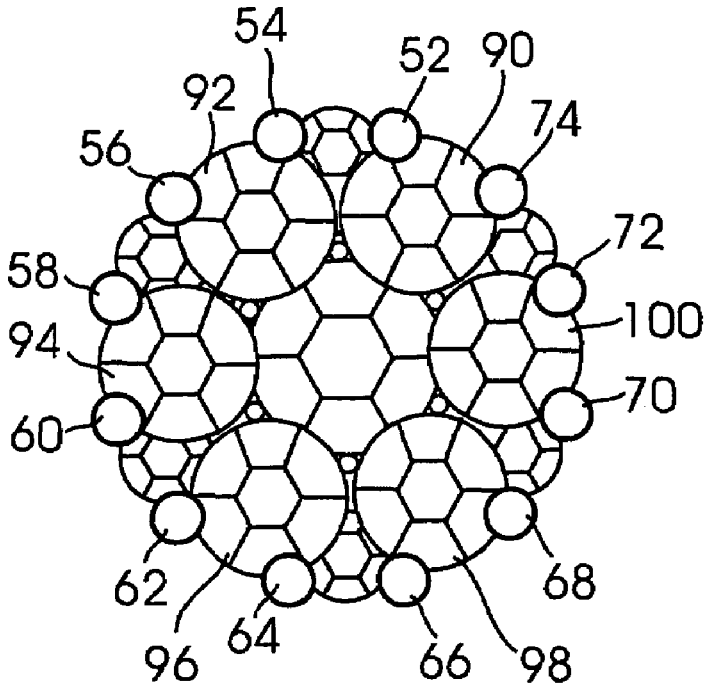
FIG. 4 is a top plan view of the completed jewelry setting with a center large diamond set in place, six outer smaller diamonds also set in place and in the same row as the center large diamond, and six intermediate diamonds on the upper layer which partially cover the large center stone and the six outer smaller stones, and which are respectively held in place by the same prongs which hold the outer smaller stones.
Figure 5:
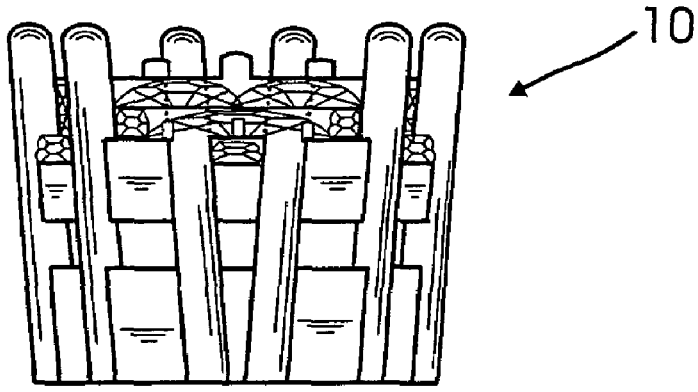
FIG. 5 is a side elevational view of the completed jewelry setting with a center large diamond set in place, six outer smaller diamonds also set in place and in the same row as the center large diamond, and six intermediate diamonds on the upper layer which partially cover the large center stone and the six outer smaller stones, and which are respectively held in place by the same prongs which hold the outer smaller stones.

Finally, the upper layer of six intermediate medium sized stones is set. Referring to FIGS. 3 and 4, each medium sized stone 90, 92, 94, 96, 98 and 100 is set so that their pavilions are respectively placed within a medium sized cavity and are respectively held adjacent its girdle by a set of two larger prongs, with a different pair of large prongs holding a smaller stone. For intermediate medium sized stone 90, its pavilion is placed within medium sized cavity 28 and it is held adjacent its girdle by large prongs 74 and 52. For intermediate medium sized stone 92, its pavilion is placed within medium sized cavity 30 and it is held adjacent its girdle by large prongs 54 and 56. For intermediate medium sized stone 94, its pavilion is placed within medium sized cavity 32 and it is held adjacent its girdle by large prongs 58 and 60. For intermediate medium sized stone 96, its pavilion is placed within medium sized cavity 34 and it is held adjacent its girdle by large prongs 62 and 64. For intermediate medium sized stone 98, its pavilion is placed within medium sized cavity 36 and it is held adjacent its girdle by large prongs 66 and 68. For intermediate medium sized stone 100, its pavilion is placed within medium sized cavity 38 and it is held adjacent its girdle by large prongs 70 and 72

As a result of this setting technique, the way the outer periphery of outer smaller stones 78, 80, 82, 84, 86 and 88 is set and held is concealed. Intermediate medium sized stones 90, 92, 94, 96, 98 and 100 rest above a portion of and partially conceal a portion of large center stone 76 and outer small stones 78, 80, 82, 84, 86 and 88. As a result, a beautiful stone pattern is achieved with a unique way to set the stones so that the way the lower periphery of outer small stones is held is concealed.

The present invention has been described with the center stone 76 being the largest and the outer periphery stones 78 through 88 being the smallest and stones 90 through 100 being the medium size stones. The stones sizes will be reduced or increased proportionately to get the overall larger or smaller outer dimension of the round shape. Stone 90 through 100 each and every stone has to be of same size similarly each stones 78 through 88 has to be of the same size too. And the center stone will always be of larger size as compared to all other stones in the mounting and the size will vary proportionately as per the stone 90 through 100 and 78 through 88.

For the above technique, the preferred stones are diamonds. However, the technique of the present invention can be used with other colored precious stones such as rubies, emeralds sapphires, etc.

Defined in detail, the present invention is a technique for setting precious stones in a mounting, comprising: (a) starting with a setting base having a floor with a large centrally disposed cavity surrounded by six small upwardly projecting prongs equally spaced around the center cavity, six medium sized cavities each respectively positioned between and radially outward from a pair of small prongs, six small cavities positioned between and radially outward from two adjacent medium sized cavities and six pairs of large upwardly projecting prongs spaced radially outward from and spaced adjacent opposite upper edges of a respective small cavity; (b) positioning a large stone having a pavilion, a girdle and a crown such that the pavilion is placed in the center cavity and the six small prongs hold the large stone by its girdle; (c) positioning six small stones each having a pavilion, a girdle and a crown such that a pavilion of each respective small stone is placed in a respective small cavity and each small stone is held through its girdle by a pair of large prongs, the large stone and the six small stones positioned so that the upper portion of their respective crowns are in the same plane; and (d) positioning six medium sized stones each having a pavilion, a girdle and a crown such that a pavilion of each respective medium sized stone is placed in a respective medium sized cavity and each medium sized stone is held through its girdle by two large prongs wherein each large prong is from an adjacent pair of prongs so that each medium sized stone partially covers the large center stone and partially covers two adjacent small stones so the way the small stones are held is not visible.

Defined broadly, the present invention is a technique for setting precious stones in a mounting, comprising: (a) starting with a setting base having a floor with a centrally disposed cavity surrounded by six small prongs spaced around the center cavity, six intermediate cavities each respectively positioned between and radially outward from a pair of small prongs, six outer cavities positioned between and radially outward from two adjacent intermediate cavities and six pairs of large upwardly projecting prongs spaced radially outward from and spaced adjacent opposite upper edges of a respective outer cavity; (b) positioning a center stone having a pavilion, a girdle and a crown such that the pavilion is placed in the center cavity and the six small prongs hold the stone; (c) positioning six outer stones each having a pavilion, a girdle and a crown such that a pavilion of each respective stone is placed in a respective outer cavity and each stone is held by a pair of large prongs, the center stone and the six outer stones positioned so that the upper portion of their respective crowns are in the same plane; and (d) positioning six intermediate stones each having a pavilion, a girdle and a crown such that a pavilion of each respective intermediate stone is placed in a respective intermediate cavity and each intermediate stone is held through its girdle by two large prongs wherein each large prong is from an adjacent pair of prongs so that each intermediate stone partially covers the center stone and partially covers two adjacent outer stones so the way the outer stones are held is not visible.

Defined more broadly, the present invention is a technique for setting precious stones in a mounting, comprising: (a) starting with a setting base having a floor with a centrally disposed cavity surrounded by six small prongs spaced around the center cavity, six intermediate cavities each respectively positioned between and radially outward from a pair of small prongs, six outer cavities positioned between and radially outward from two adjacent intermediate cavities and six pairs of large upwardly projecting prongs spaced radially outward from and spaced adjacent opposite upper edges of a respective outer cavity; (b) positioning a center stone having a pavilion, a girdle and a crown such that the pavilion is placed in the center cavity and the six small prongs hold the stone; (c) positioning six outer stones such that a portion of each respective stone is placed in a respective outer cavity and each stone is held by a pair of large prongs, the center stone and the six outer stones positioned so that they are in the same plane; and (d) positioning six intermediate stones such that a portion of each respective intermediate stone is placed in a respective intermediate cavity and each intermediate stone is held by two large prongs wherein each large prong is from an adjacent pair of prongs so that each intermediate stone partially covers the center stone and partially covers two adjacent outer stones so the way the outer stones are held is not visible.

Defined even more broadly, the present invention is a technique for setting precious stones in a mounting, comprising: (a) starting with a setting base having a floor with a centrally disposed cavity surrounded by a multiplicity of small prongs spaced around the center cavity, a multiplicity of intermediate cavities each respectively positioned between and radially outward from a pair of small prongs, a multiplicity of outer cavities positioned between and radially outward from two adjacent intermediate cavities and a multiplicity of pairs of large upwardly projecting prongs spaced radially outward from and spaced adjacent opposite upper edges of a respective outer cavity; (b) positioning a center stone so that a portion of the stone is placed in the center cavity and the multiplicity of small prongs hold the stone; (c) positioning a multiplicity of outer stones such that a portion of each respective stone is placed in a respective outer cavity and each stone is held by a pair of large prongs, the center stone and the multiplicity of outer stones positioned so that they are in the same plane; and (d) positioning a multiplicity of intermediate stones such that a portion of each respective intermediate stone is placed in a respective intermediate cavity and each intermediate stone is held by two large prongs wherein each large prong is from an adjacent pair of prongs so that each intermediate stone partially covers the center stone and partially covers two adjacent outer stones so the way the outer stones are held is not visible.

Defined even more broadly, the present invention is a technique for setting precious stones in a mounting, comprising: (a) starting with a setting base having a floor with a centrally disposed cavity surrounded by a multiplicity of small prongs spaced around the center cavity, a multiplicity of intermediate cavities each respectively positioned between and radially outward from a pair of small prongs, a multiplicity of outer cavities positioned between and radially outward from two adjacent intermediate cavities and a multiplicity of pairs of large upwardly projecting prongs spaced radially outward from and spaced adjacent opposite upper edges of a respective outer cavity; (b) positioning a center stone so that a portion of the stone is placed in the center cavity and the multiplicity of small prongs hold the stone; (c) positioning a multiplicity of outer stones such that a portion of each respective stone is placed in a respective outer cavity and each stone is held by a pair of large prongs; and (d) positioning a multiplicity of intermediate stones such that a portion of each respective intermediate stone is placed in a respective intermediate cavity and each intermediate stone is held by two large prongs wherein each large prong is from an adjacent pair of prongs so that each intermediate stone partially covers the center stone and partially covers two adjacent outer stones so the way the outer stones are held is not visible.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A technique for setting precious stones in a mounting, comprising:

a. starting with a setting base having a floor with a large centrally disposed cavity surrounded by six small upwardly projecting prongs equally spaced around the center cavity, six medium sized cavities each respectively positioned between and radially outward from a pair of small prongs, six small cavities positioned between and radially outward from two adjacent medium sized cavities and six pairs of large upwardly projecting prongs spaced radially outward from and spaced adjacent opposite upper edges of a respective small cavity;

b. positioning a large stone having a pavilion, a girdle and a crown such that the pavilion is placed in the center cavity and the six small prongs hold the large stone by its girdle;

c. positioning six small stones each having a pavilion, a girdle and a crown such that a pavilion of each respective small stone is placed in a respective small cavity and each small stone is held through its girdle by a pair of large prongs, the large stone and the six small stones positioned so that the upper portion of their respective crowns are in the same plane; and d. positioning six medium sized stones each having a pavilion, a girdle and a crown such that a pavilion of each respective medium sized stone is placed in a respective medium sized cavity and each medium sized stone is held through its girdle by two large prongs wherein each large prong is from an adjacent pair of prongs so that each medium sized stone partially covers the large center stone and partially covers two adjacent small stones so the way the small stones are held is not visible.

2. The technique in accordance with claim 1 wherein each stone is a diamond.

3. A technique for setting precious stones in a mounting, comprising:

a. starting with a setting base having a floor with a centrally disposed cavity surrounded by six small prongs spaced around the center cavity, six intermediate cavities each respectively positioned between and radially outward from a pair of small prongs, six outer cavities positioned between and radially outward from two adjacent intermediate cavities and six pairs of large upwardly projecting prongs spaced radially outward from and spaced adjacent opposite upper edges of a respective outer cavity;

b. positioning a center stone having a pavilion, a girdle and a crown such that the pavilion is placed in the center cavity and the six small prongs hold the stone;

c. positioning six outer stones each having a pavilion, a girdle and a crown such that a pavilion of each respective stone is placed in a respective outer cavity and each stone is held by a pair of large prongs, the center stone and the six outer stones positioned so that the upper portion of their respective crowns are in the same plane; and d. positioning six intermediate stones each having a pavilion, a girdle and a crown such that a pavilion of each respective intermediate stone is placed in a respective intermediate cavity and each intermediate stone is held through its girdle by two large prongs wherein each large prong is from an adjacent pair of prongs so that each intermediate stone partially covers the center stone and partially covers two adjacent outer stones so the way the outer stones are held is not visible.

4. The technique in accordance with claim 3 wherein each stone is a diamond.

5. A technique for setting precious stones in a mounting, comprising:

a. starting with a setting base having a floor with a centrally disposed cavity surrounded by six small prongs spaced around the center cavity, six intermediate cavities each respectively positioned between and radially outward from a pair of small prongs, six outer cavities positioned between and radially outward from two adjacent intermediate cavities and six pairs of large upwardly projecting prongs spaced radially outward from and spaced adjacent opposite upper edges of a respective outer cavity;

b. positioning a center stone having a pavilion, a girdle and a crown such that the pavilion is placed in the center cavity and the six small prongs hold the stone;

c. positioning six outer stones such that a portion of each respective stone is placed in a respective outer cavity and each stone is held by a pair of large prongs, the center stone and the six outer stones positioned so that they are in the same plane; and d. positioning six intermediate stones such that a portion of each respective intermediate stone is placed in a respective intermediate cavity and each intermediate stone is held by two large prongs wherein each large prong is from an adjacent pair of prongs so that each intermediate stone partially covers the center stone and partially covers two adjacent outer stones so the way the outer stones are held is not visible.

6. The technique in accordance with claim 5 wherein each stone is a diamond.

7. A technique for setting precious stones in a mounting, comprising:

a. starting with a setting base having a floor with a centrally disposed cavity surrounded by a multiplicity of small prongs spaced around the center cavity, a multiplicity of intermediate cavities each respectively positioned between and radially outward from a pair of small prongs, a multiplicity of outer cavities positioned between and radially outward from two adjacent intermediate cavities and a multiplicity of pairs of large upwardly projecting prongs spaced radially outward from and spaced adjacent opposite upper edges of a respective outer cavity;

b. positioning a center stone so that a portion of the stone is placed in the center cavity and the multiplicity of small prongs hold the stone;

c. positioning a multiplicity of outer stones such that a portion of each respective stone is placed in a respective outer cavity and each stone is held by a pair of large prongs, the center stone and the multiplicity of outer stones positioned so that they are in the same plane; and d. positioning a multiplicity of intermediate stones such that a portion of each respective intermediate stone is placed in a respective intermediate cavity and each intermediate stone is held by two large prongs wherein each large prong is from an adjacent pair of prongs so that each intermediate stone partially covers the center stone and partially covers two adjacent outer stones so the way the outer stones are held is not visible.

8. The technique in accordance with claim 7 wherein each stone is a diamond.

9. A technique for setting precious stones in a mounting, comprising:

a. starting with a setting base having a floor with a centrally disposed cavity surrounded by a multiplicity of small prongs spaced around the center cavity, a multiplicity of intermediate cavities each respectively positioned between and radially outward from a pair of small prongs, a multiplicity of outer cavities positioned between and radially outward from two adjacent intermediate cavities and a multiplicity of pairs of large upwardly projecting prongs spaced radially outward from and spaced adjacent opposite upper edges of a respective outer cavity;

b. positioning a center stone so that a portion of the stone is placed in the center cavity and the multiplicity of small prongs hold the stone;

c. positioning a multiplicity of outer stones such that a portion of each respective stone is placed in a respective outer cavity and each stone is held by a pair of large prongs; and d. positioning a multiplicity of intermediate stones such that a portion of each respective intermediate stone is placed in a respective intermediate cavity and each intermediate stone is held by two large prongs wherein each large prong is from an adjacent pair of prongs so that each intermediate stone partially covers the center stone and partially covers two adjacent outer stones so the way the outer stones are held is not visible.

10. The technique in accordance with claim 9 wherein each stone is a diamond.

* * * * *